US005322452A

United States Patent [19]

Mosquera

[11] Patent Number: 5,322,452

[45] Date of Patent: Jun. 21, 1994

[54] HOLDDOWN SYSTEM FOR CONNECTOR

[75] Inventor: Rene A. Mosquera, Laguna Niguel, Calif.

[73] Assignee: ITT Corporation, Secaucus, N.J.

[21] Appl. No.: 910,139

[22] PCT Filed: May 29, 1992

[86] PCT No.: PCT/US92/04506

§ 371 Date: Jul. 14, 1992

§ 102(e) Date: Jul. 14, 1992

[51] Int. Cl.[5] ..... H01R 13/73

[52] U.S. Cl. ..... 439/567; 439/571

[58] Field of Search ..... 228/120, 139; 439/83, 439/571, 572, 874, 876, 567, 557, 554, 552, 555

[56] References Cited

U.S. PATENT DOCUMENTS 4,585,295 4/1986 Ackerman ..... 439/857

5,108,308 4/1992 Northcraft et al. ..... 439/555

FOREIGN PATENT DOCUMENTS 250097 12/1987 European Pat. Off. .

4016890 11/1991 Fed. Rep. of Germany .

2249804 5/1992 United Kingdom .

*Primary Examiner*—Cary F. Paumen

*Attorney, Agent, or Firm*—Thomas L. Peterson

[57] ABSTRACT

A connector is provided whose plastic housing includes downwardly-depending pegs for insertion in a circuit board to hold the connector in place, which provides for secure holding of the pegs in the circuit board holes by merely pressing the connector down into place. A spring clip (32, FIG. 2) is mounted on each peg, each clip having outwardly-bowed arms (36, 38) whose middle can press against the walls of the circuit board hole (14) to securely hold the peg in the hole, and whose lower ends are supported by the peg.

11 Claims, 4 Drawing Sheets

FIG. 1
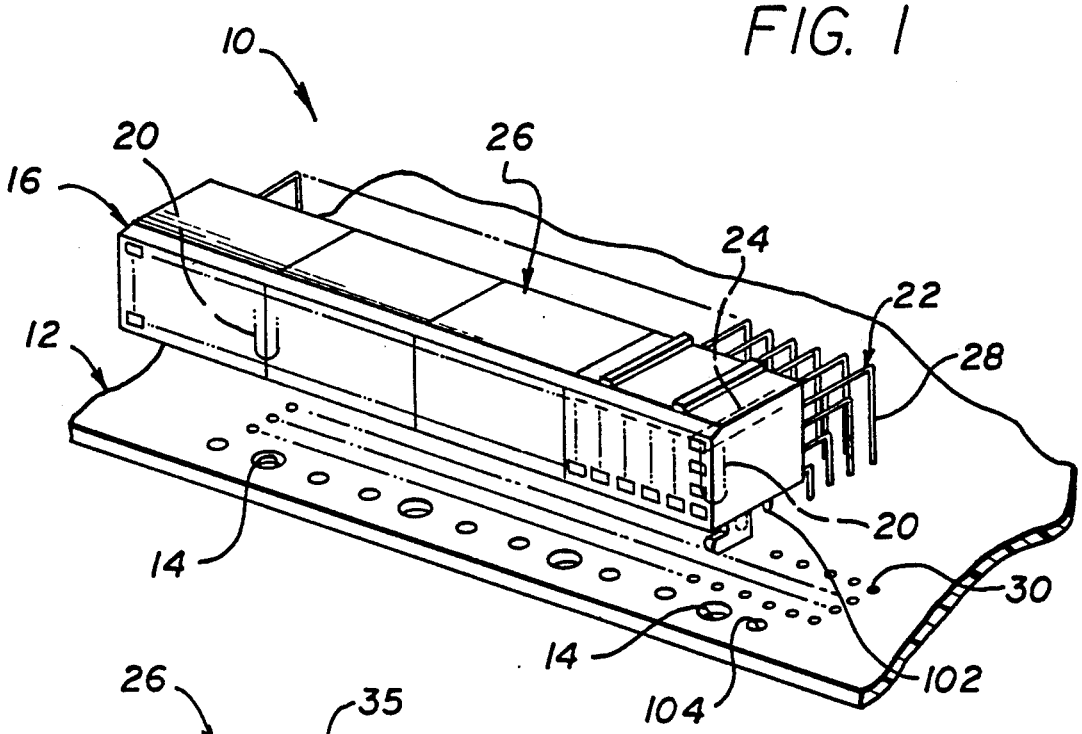
FIG. 2
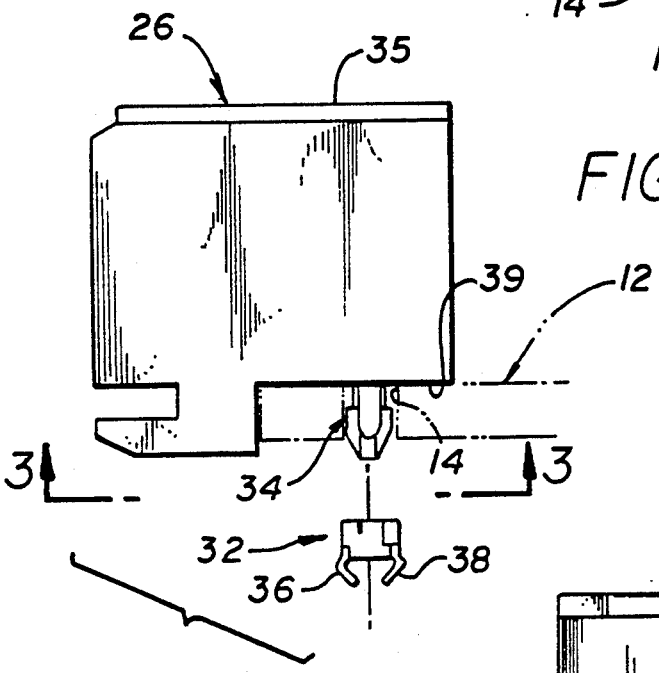
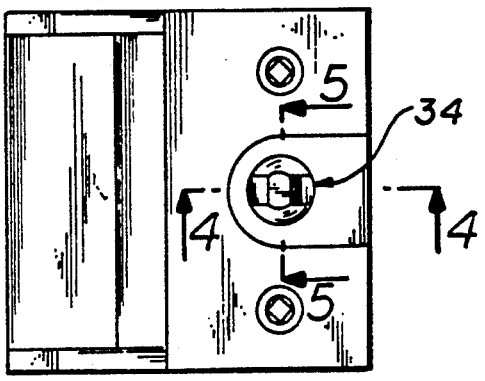
FIG. 3

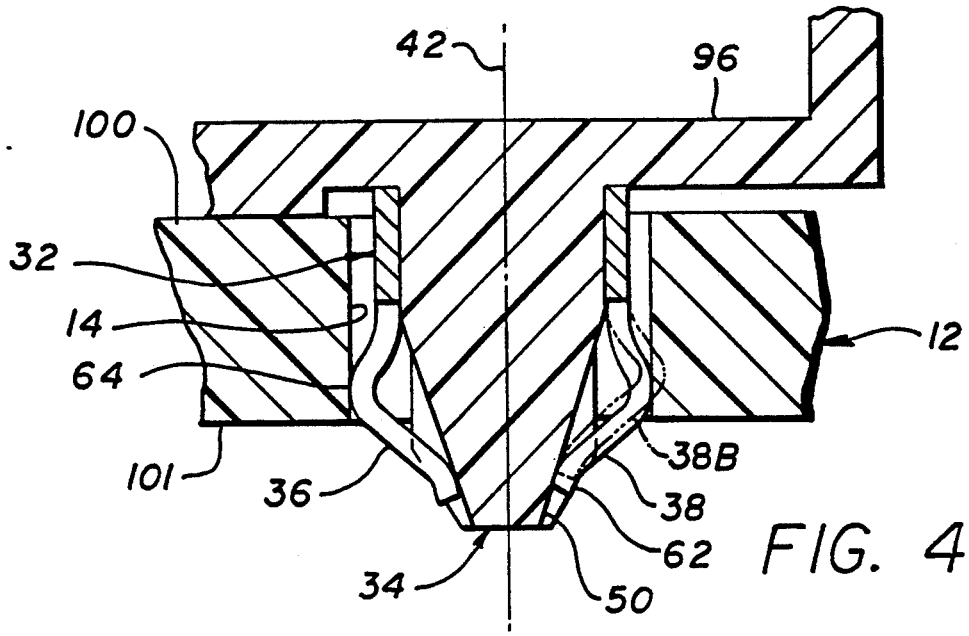
FIG. 4
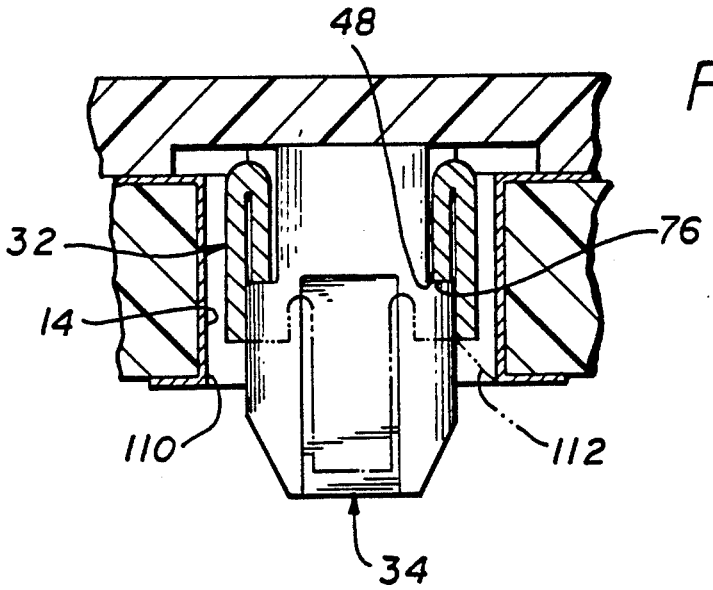
FIG. 5
FIG. 8
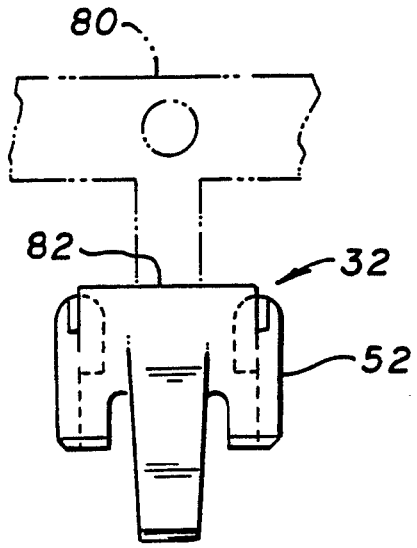
FIG. 7
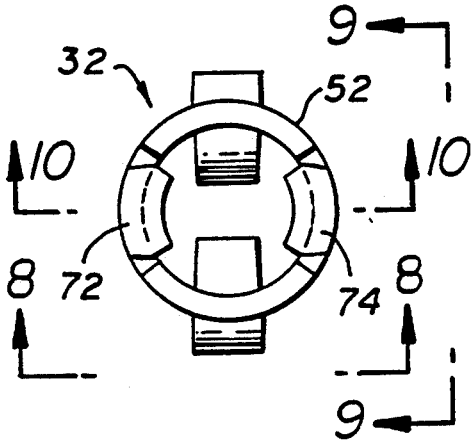

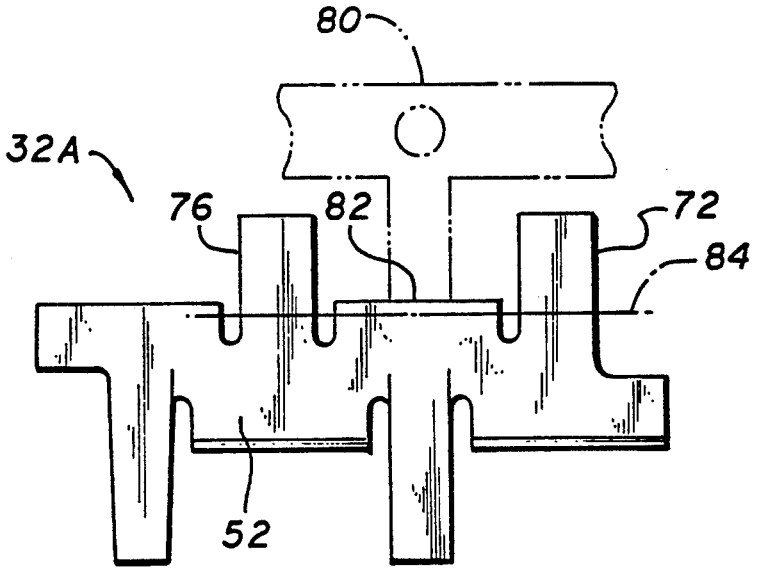
FIG. 11
FIG. 12
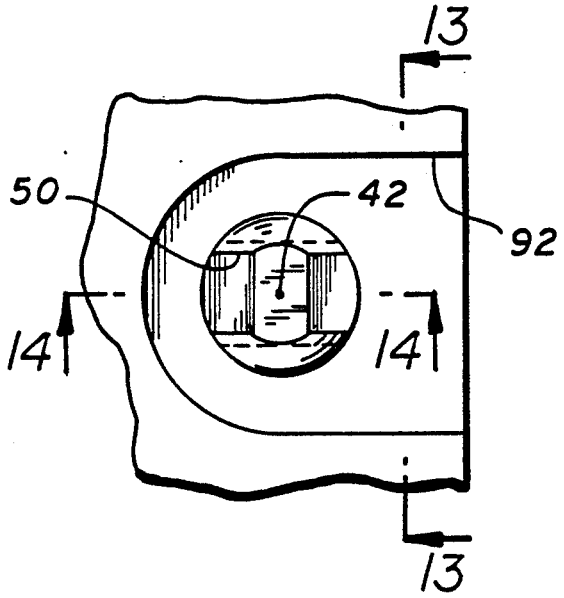
FIG. 13
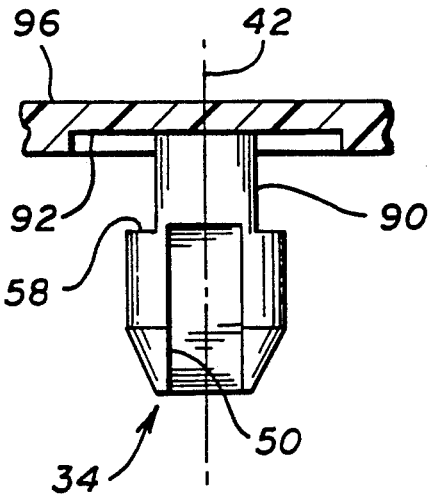
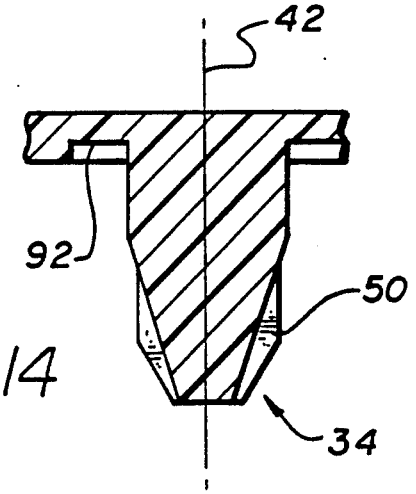
FIG. 14

HOLDDOWN SYSTEM FOR CONNECTOR

BACKGROUND OF THE INVENTION

One type of connector which mounts near the edge of a circuit board, includes a housing molded of a polymer. The housing includes a main portion which rests on the upper surface of the circuit board and several depending pegs that extend through round holes in the circuit board. After the pegs are inserted through the holes, downwardly protruding portions of the pegs are heat staked to melt the ends of the plastic legs so portions thereof extend against the bottom surface of the circuit board and thereby lock the connector to the board. Companies which purchase the connectors to mount on circuit boards, often wish to avoid the secondary operation of heat staking. Heat staking adds cost to the assembly and is often perceived as unreliable and as being inconsistent or difficult to monitor in a manufacturing environment. If the pegs could be constructed by the connector manufacturer, so the pegs automatically securely locked to the board upon merely pressing the connector down against the board, the assembly cost for the customer could be significantly reduced.

SUMMARY OF THE INVENTION

In accordance with one embodiment of the present invention, a board-mounted connector assembly of low cost is provided, which enables the connector to be mounted on the board by merely pressing the connector into place. The connector includes a polymer-molded housing with a main part that lies above the board and with integrally molded pegs which each projects down into a board hole. A plurality of metal clips are provided, each mounted on one of the pegs and having resilient arms that press outwardly against the walls of the hole. The connector manufacturer installs the clips on the pegs, and the customer can mount the connector on a board by merely drilling round holes in a board and pressing down the connector so the pegs with the clips thereon move down into the board holes and automatically held in place.

Each clip can be constructed with a band that mounts about a portion of the peg, a plurality of arms extending largely downwardly but with a bowed portion for bearing against the walls of the hole, and an upper portion which locks into place on the peg. The arms have free lower ends which slidably bear against lower portions of the peg, so opposite ends of each arm are supported although the lower end can slide as the middle is deflected. The upper portion of each clip includes a leg with one end extending upwardly from the band but bent around in a 180° loop, to form a downwardly-extending part with a tip that lies against an upwardly-facing shoulder formed on the peg.

The novel features of the invention are set forth with particularity in the appended claims. The invention will be best understood from the following description when read in conjunction with the accompanying drawings.

BRIEF DESCRIPTION OF THE DRAWINGS

FIG. 1 is an exploded isometric view of a connector and a portion of a circuit board on which the connector can mount.

FIG. 2 is an exploded side elevation view of the connector of FIG. 1, but without the contacts, and showing in phantom lines a portion of the circuit board.

FIG. 3 is a view taken on the line 3—3 of FIG. 2.

FIG. 4 is a sectional view taken on the line 4—4 of FIG. 3.

FIG. 5 is a partial sectional view taken on the line 5—5 of FIG. 3.

FIG. 7 is a plan view of the clip of FIG. 6.

FIG. 8 is a view taken on the line 8—8 of FIG. 7, and also showing in phantom lines, a carrier which holds the clip prior to its installation.

FIG. 11 is a plan view of the clip of FIG. 7, showing it after it has been blanked from a metal sheet, but prior to bending thereof.

FIG. 12 is an enlarged view of a portion of the connector of FIG. 3 without the clip.

FIG. 13 is a view taken on the line 13—13 of FIG. 12.

FIG. 14 is a sectional view taken on the line 14—14 of FIG. 12.

DESCRIPTION OF THE PREFERRED EMBODIMENT

Figure 6:
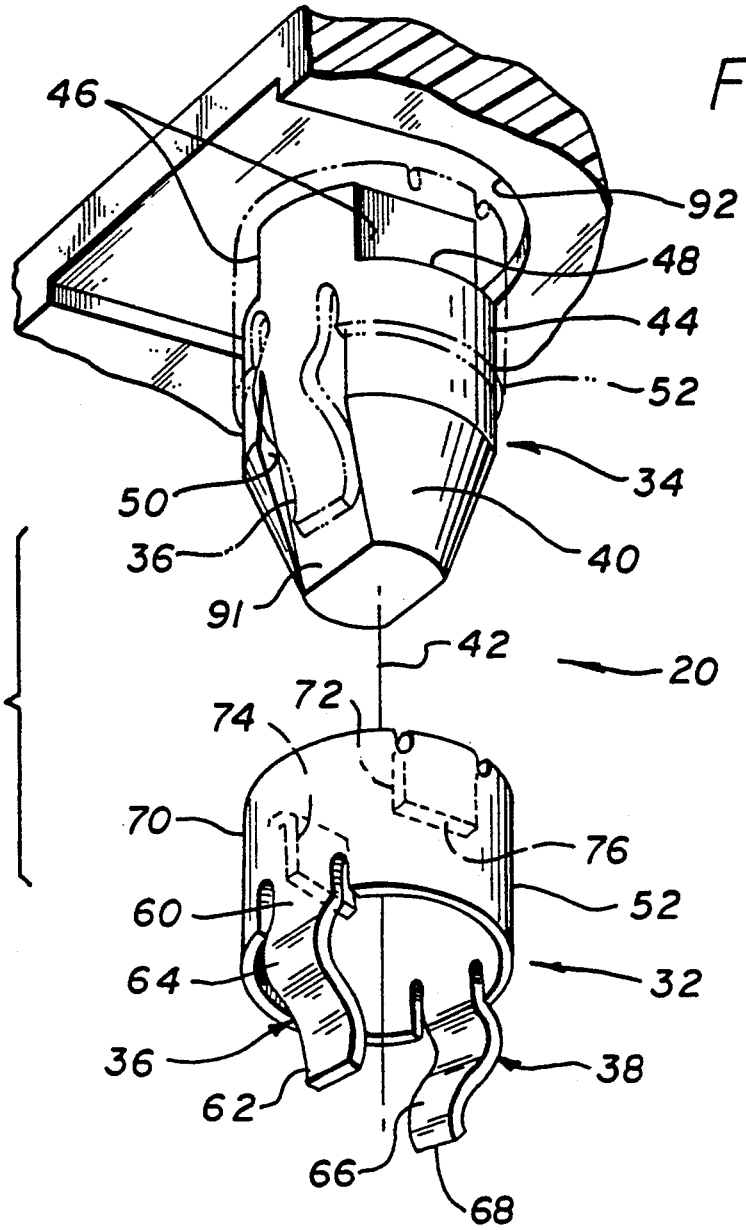
FIG. 6 is a partial exploded bottom view of a portion of the connector of FIG. 1, showing a peg and a clip that can mount thereon, and also showing in phantom line the clip mounted on the peg.
Figure 9:
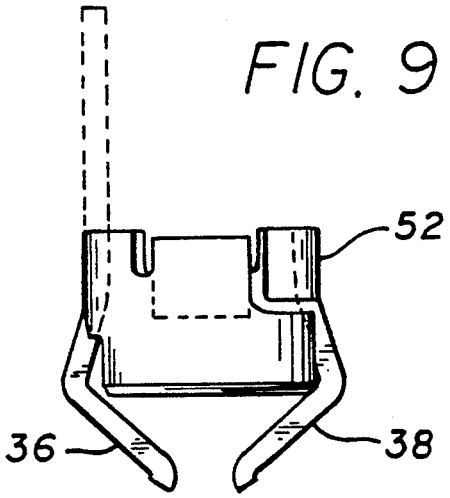
FIG. 9 is a view taken on the line 9—9 of FIG. 7.
Figure 10:
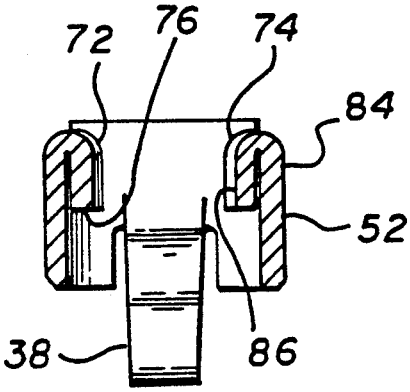
FIG. 10 is a sectional view taken on the line 10—10 of FIG. 7.

FIG. 1 shows a board-mounted connector assembly 10 which includes a circuit board 12 having a plurality of peg-receiving holes 14, and a connector 16 having a plurality of peg assemblies 20 which mount in the board holes 14. The connector has a plurality of socket contacts 22 with socket portions 24 mounted in a connector housing 26 for receiving pin contacts. The contacts have tails 28 which project from the housing and are designed to be received in board contact holes 30 formed by plated holes and surrounding traces of the circuit board. This general type of connector assembly has been widely used, but instead of the peg assemblies 20, simple pegs were used in the form of simple cylindrical rods that projected through holes in the circuit board. After initial installation, the bottom of the plastic pegs were heat staked, to melt the bottoms of the pegs so they lay against the lower surface of the board. The need to provide heat staking equipment with heads adapted to melt the particular pegs, increases the cost for the customer who assembles the connector on the circuit board.

In accordance with the present invention, applicant provides a metal clip 32 (FIG. 2) which fits on a plastic peg 34 that is molded integrally with a main housing part 35 of the housing 26. The clip 32 locks onto the peg 34, and has spring arms 36, 38 that bear against the walls of the peg-receiving hole 14 of the circuit board. With a bottom surface 39 of the main housing part lying against the circuit board, the peg-and-clip assembly secures the connector to the board. As shown in FIG. 6, each peg 36 has a tapered lower portion 40 which is of progressively smaller width at progressively lower locations along the axis 42 of the peg and clip, the illustrated peg having a lower portion that is largely conical. The peg has an upper portion 44 which is largely cylindrical, and which includes cutouts 46 forming upwardly-facing shoulders 48. The peg also forms a pair of grooves 50 that lie on opposite sides of the peg and extend along the lower portion 40 and partially into the upper portion 44. Each groove has an inner wall 91 that extends downwardly and with a radially inward directional component (i.e. toward axis 42).

The clip 32 includes a band portion or band 52 which is designed to closely surround the upper portion 44 of the peg. The arms 36, 38 each have upper portions 60 mounted on the band, lower portions 62 designed to lie in the grooves 50, and outwardly-bowed middle portions 64. The middle portions 64 are designed to press against the walls of the board hole to anchor the peg-pin assembly 20 to the circuit board. Since both ends 60, 62 of each arm are supported, they both resist inward deflection of the middle 64 of the arm, to enable the arm to provide large resistance against deflection by the walls of the board hole. The lower part 62 of each arm can shift position upwardly or downwardly along a corresponding groove 50 of the peg, to accommodate inward and outward deflection of the arm middle 64. It can be seen in FIG. 6 that the arm lower parts 62 have convexly rounded inner surface locations 66 lying above the extreme lower ends 68 of the clip, which provides low friction sliding of the arm lower parts on the pegs.

The clip has an upper portion 70 that includes a pair of locking legs 72, 74 lying on opposite sides of the axis 42. Each leg has a downwardly-facing tip 76 which is designed to engage a corresponding upwardly-facing shoulder 48 of the peg 48, to thereby lock the clip onto the peg.

FIGS. 7–11 illustrate details of the clip 32. As shown in FIG. 11, the clip is originally cut from a sheet of metal, and originally has the shape shown at 32A, with the sheet of metal including a carrier strip 80 which will eventually be cut away along the line 82. The band portion or band 52 of the clip is bent into a circle as shown in FIG. 7. The locking legs 72, 74 are bent approximately 180° about axis 84 (FIG. 11) to form the legs. Each leg initially extends upwardly, but is bent over to form an end portion 86 (FIG. 10) furthest from the band 52, with the end portion 86 extending downwardly and with the tip 76 of the leg facing downwardly to abut a shoulder on the peg.

FIGS. 12–14 show details of the plastic peg 36. It is noted that the top part 90 of the peg upper portion extends upwardly into a recess 92 formed in a lower wall 96 of the connector housing. The recess 92 enables a somewhat longer peg to be used, to accommodate the considerable vertical length of the clip, without the peg projecting very far below the bottom surface of the circuit board. It is noted that prior connectors of this type, wherein the bottom of a peg was heat staked, resulted in the heat staked part projecting below the lower surface of the circuit board by only about one half the thickness of the circuit board. Applicant constructs the peg-clip assembly so it does not project any further than the stake portion of prior connectors.

FIGS. 4 and 5 illustrate the clip 32 mounted on the peg 36, and with the peg-and-clip assembly mounted in a hole 14 of the circuit board 12. It can be seen that the spring arms such as arm 38, initially lies in a position shown at 38B. However, as the peg and clip are inserted into the circuit board hole, the middle 64 of each arm deflects radially inwardly, towards the axis 42, while the lower part 62 of the arm slides along the walls of the peg groove 50.

The connector housing 26 is injection molded to the shape shown, with the pegs integral with the rest of the housing. The connector shown has four modules 98 whose housing are individually molded and then held to other housings, although the entire connector housing can be molded in a single cavity. The clips are blanked from sheet metal and are rolled and otherwise formed to the shape shown. The connector manufacturer installs each clip by moving the clip upwardly along the peg until the tips 76 (FIG. 5) of the clip arms "snap" above the peg shoulders 48. The connector with the peg-and-clip assemblies can be placed over the upper surface 100 of the circuit board and with the pegs aligned with the holes in the circuit board. The tapered lower ends of the peg help them align with the holes. The connector can be pressed down with a simple press to move all peg-and-clip assemblies into corresponding holes. When fully installed, the pegs extend below the lower surface 101 of the board.

It may be noted that FIG. 1 shows small retention pins 102 on the lower surface of the connector housing, which are intended to insert into retention pin-receiving apertures 104 formed in a circuit board. Such retention pins provide additional guidance during installation of the connector on the PC board, and provide stress relief for the contact solder joints by withstanding stresses caused by repeated connector mate/unmate cycles.

The connector can be installed in unplated peg holes, or in plated peg holes of a circuit board. The presence of the clip has an advantage when used in plated holes, in that it enables soldering of the clip to the walls of the circuit board holes. As shown in FIG. 5, a metal plating 110 can be used on the circuit board hole 14. After the connector is installed, a soldering operation, such as a wave soldering operation is commonly performed to solder the contact tail to the holes in the circuit board. Such soldering operation will result in quantities of solder indicated at 112 adhering to the metal plating 110 of the peg-receiving holes, as well as to the metal clip 32. Such soldering holds the peg-and-clip assembly even more securely to the circuit board.

It should be noted that in describing the parts of the connector, terms such as "upper", "lower", "vertical", etc. have been used only to facilitate the description of the invention as illustrated. The connector and its pegs and clips as well as the circuit board, can be used in any orientation with respect to gravity.

Thus, the invention provides a peg device or assembly which can securely hold a connector to a circuit board, which enables installation of the connector by merely pressing it down in place (which may be followed by a soldering operation). This is accomplished by forming the connector housing with integrally molded pegs, and by mounting a spring clip on each plastic peg. The clips are preferably formed of copper alloy metal. Each clip has one or more resilient spring arms that are biased outwardly to press against the walls of a circuit board hole. The arms can have upper ends extending from a band which surrounds the peg, lower ends which are slidably supported by a lower portion of the peg, and a middle which is outwardly bowed (relative to the axis of the peg and clip), to enable each arm to press forcefully against the walls of the circuit board hole. The clip can be locked to the peg by forming the peg with one or more upwardly-facing shoulder portions, and forming the clip with arms that are bent about 180° to form downwardly-facing tips that abut the shoulders of the peg. The bottom wall of the connector main housing portion can include a recess about the peg, to enable a longer peg to be accommodated.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A board-mounted connector assembly which includes a circuit board having a plurality of peg-receiving holes that each has upper and lower ends, and a connector which has a housing molded of a polymer which includes a main part that lies above said board and which includes a plurality of integrally molded pegs which each project downwardly into a respective one of said board holes, characterized by:

a plurality of spring clips, each mounted on a respective one of said pegs and having at least one resilient arm that presses outwardly against a location on a wall of one of said holes, where said location lies between said upper and lower ends of said one of said holes.

2. The assembly described in claim 1 wherein:

each of said clips includes an upper portion mounted on said peg, and each of said clips includes at least one arm having an upper end extending largely downwardly from said clip upper portion, a free lower and slidably supported against said peg, and an outwardly bent middle that engages the walls of said board hole, with said free lower arm ends having extreme lower ends and having convexly rounded inner surface locations that lie above said lower ends and that slidably engage said peg.

3. The assembly described in claim 1 wherein:

said clips are each formed of sheet metal, said peg-receiving holes have hole walls that are metal plated, and said assembly includes a quantity of solder soldering each clip to the walls of a corresponding plated hole.

4. A connector-to-circuit board retainer for holding a connector on a circuit board by insertion into a round hole of the circuit board, comprising:

a molded polymer peg having an axis, and being insertable into said hole;

a metal clip mounted on said peg and having a plurality of deflectable arms extending further from said axis than any part of said peg, said arms adapted to press against the walls of said hole, and said arms each having free lower ends slidably disposed on said peg, with said free lower ends having extreme lower ends and having convexly rounded inner surface locations that lie above said extreme lower ends, with said rounded inner surface locations being slidably disposed on said peg.

5. The retainer described in claim 4 wherein:

said peg has a lower end portion which forms a plurality of grooves that each receives one of said clip free lower ends.

6. A method for mounting a connector on a circuit board that has upper and lower surfaces by drilling a plurality of round through holes in said board wherein each hole has upper and lower ends respectively at said upper and lower surfaces, molding said connector of polymer material with a main bottom wall to lie against a surface of said board, and with a plurality of pegs depending from said bottom wall to extend into said holes, characterized by:

forming a sheet of metal into a plurality of clips, and mounting each clip on one of said pegs, wherein each clip has a plurality of bendable arms for entering into one of said holes and pressing against the walls of said hole;

lowering said connector until said pegs and clips lie in line with said board holes and substantially against said board, and pressing down said connector to force said clips downwardly by a distance into said holes so said clip arms press against hole locations spaced from both said upper and lower ends of said holes.

7. The method described in claim 6 wherein:

said board has a plurality of conductive traces;

said connector as a plurality of contacts with tails that engage said board traces;

plating the walls of each of said board holes;

soldering said board traces to said contact tails; and simultaneously soldering each of said clips to the plating of a board hole.

8. A board-mounted connector assembly which includes a circuit board having a plurality of peg-receiving holes, and a connector which has a housing molded of a polymer which includes a main part that lies above said board and which includes a plurality of integrally molded pegs which each project downwardly into a respective one of said board holes, characterized by:

a plurality of spring clips, each mounted on one of said pegs and having at least one resilient arm that presses outwardly against a wall of one of said holes;

each of said pegs forms at least two upwardly-facing shoulders;

each of said clips is formed of sheet metal and has at least two 180° bent legs each forming a leg part with a free end thereof substantially abutting one of said shoulders.

9. A connector-to-circuit board retainer for holding a connector on a circuit board by insertion into a round hole of the circuit board, comprising:

a molded polymer peg having an axis, and being insertable into said hole, said peg having a lower end portion which projects vertically downwardly into said board hole;

a metal clip having an upper end portion that is locked to said peg and having a plurality of deflectable arms extending further from said axis than any part of said peg, said arms adapted to press against the walls of said hole;

said clip has a lower end portion that forms a plurality of arms with upper ends held by said clip upper end portion, free lower arm ends that are each slidably disposed on said peg, and an arm middle which is outwardly bowed away from said peg axis to engage the walls of said board hole;

said peg lower portion has a plurality of largely vertically-extending grooves, each groove having an inner wall extending downwardly and with a radially-inward directional component, and each arm lower end is slidably received in one of said grooves.

10. A connector-to-circuit board retainer for holding a connector on a circuit board by insertion into a round hole of the circuit board, comprising:

a molded polymer peg having an axis, and being insertable into said hole;

a metal clip mounted on said peg and having a plurality of deflectable arms extending further from said axis than any part of said peg, said arms adapted to press against the walls of said hole;

said peg has an upper portion forming a plurality of upwardly-facing shoulder portions;

said clip has an upper end portion that includes at least two legs with free ends, each leg bent in a largely 180° loop with the free ends facing downwardly and lying substantially against one of said peg shoulder portions.

11. A method for mounting a connector on a circuit board by drilling a plurality of round holes in said board, molding said connector of polymer material with a main bottom wall to lie against a surface of said board, and with a plurality of pegs depending from said bottom wall to extend into said holes, characterized by:

forming a sheet of metal into a plurality of clips, and mounting each clip on one of said pegs, wherein each clip has a plurality of bendable arms for entering into a reference one of said holes and pressing against the walls of said hole;

lowering said connector until said pegs and clips lie in line with said board holes and substantially against said board, and pressing down said connector to force said clips into said holes;

said steps of molding includes forming each of said pegs with a plurality of upward-facing shoulder portions;

said step of forming said clips includes forming each of said clips with a vertically extending axis and with an upper portion that includes a band for surrounding said peg and a plurality of legs initially extending upwardly form said band, and bending over each leg so an end portion of the leg furthest from said band extends downwardly and lies radially inwardly of the leg end portion closest to said band and so the tip of the leg faces downwardly;

said step of mounting includes pushing each clip upwardly onto a peg until said tips of said legs each snaps into a position above one of said peg shoulder portions.

* * * * *